United States Patent [19]

Vartia

[11] 4,185,749

[45] Jan. 29, 1980

[54] CAN BODY FOR AN AEROSOL CONTAINER

[75] Inventor: Matti Vartia, Helsinki, Finland

[73] Assignee: Printal Oy, Helsinki, Finland

[21] Appl. No.: 658,607

[22] Filed: Feb. 17, 1976

[30] Foreign Application Priority Data

Feb. 21, 1975 [FI] Finland ..... 750495

[51] Int. Cl.[2] ..... B65D 7/42

[52] U.S. Cl. ..... 220/72; 113/120 H; 220/DIG. 22

[58] Field of Search .....220/72, 74, DIG. 13, 220/1 BC, 3, DIG. 22; 113/120 H; D9/211-214, 119, 131, 129, 130

[56] References Cited

U.S. PATENT DOCUMENTS

| | | | |
|---|---|---|---|
| 1,200,309 | 10/1916 | Carlson | 220/DIG. 13 |
| 1,286,384 | 12/1918 | Mezger | 113/120 H |
| 1,931,210 | 10/1933 | Steinacher | 113/120 H |
| 2,425,448 | 8/1947 | Weida | 220/3 |

FOREIGN PATENT DOCUMENTS

| | | | |
|---|---|---|---|
| 1472123 | 12/1965 | France | 220/DIG. 13 |
| 685902 | 1/1953 | United Kingdom | 220/1 BC |

*Primary Examiner*—Allan N. Shoap

*Attorney, Agent, or Firm*—Haseltine, Lake & Waters

[57] ABSTRACT

Disclosed is a can body for a case, e.g. for an aerosol container, made of metal, such as aluminum. The thickness of the material of the cylindrical mouth section of the can body is greater than that of the other mantle sections of the can body. Below the mouth section the other surface of the mantle of the blank is polygonal as far as the lower section of the can body, the greatest outer diameter of the polygon being smaller than or equal to the outer diameter of the mouth section. The outer surface of the lower mantle section of the can body is cylindrical, the outer diameter of the cylinder being smaller than the smallest outer diameter of the polygonal section of the mantle. The inner surface of the mantle of the can body is cylindrical over its entire length. Disclosed is additionally a device for manufacturing the can body by cold extension of metal, e.g. aluminum, softened by annealing, having a ram with a cylindrical side wall and an extrusion ring comprising a greater cylindrical mouth section, a polygonal middle section and a smaller cylindrical lower section, corresponding to respective sections of the case can body to be manufactured.

1 Claim, 7 Drawing Figures

CAN BODY FOR AN AEROSOL CONTAINER

BACKGROUND OF THE INVENTION

The present invention relates to a can body for a case, especially for an aerosol container, made of a metal such as aluminum, the thickness of the material of the cylindrical mouth section of the can body being greater than that of the rest of the mantle of the can body, and to a device for manufacturing the can body by cold extrusion.

Can body for cases, especially for aerosol containers, are generally manufactured from aluminum by cold extrusion. Thereby the can body becomes a cylindrical surface. The mouth section of the can body is made thicker than the rest of the can body mantle since the mouth section must be restricted at a later stage. Below the mouth section the can body mantle remains cylindrical.

SUMMARY OF THE INVENTION

The can body for a case, according to the invention is characterized in that below the mouth section, as far as the lower section of the can body, the outer surface of the can body mantle is polygonal in a cross section of the mantle, the greatest outer diameter of the polygon being smaller than, or equal to the outer diameter of the mouth section, that the lower section of the can body mantle has a cylindrical outer surface, the outer diameter of the cylinder being smaller than the smallest outer diameter of the polygonal section of the mantle, and that the inner surface of the can body mantle is cylindrical over its entire length.

Since the question is of a mass-produced article made from a relatively expensive material, savings of material are factors really worth taking into consideration. When the can body for a case according to the invention is made such that the outer surface of the mantle is polygonal in a cross section of the mantle, raw material is saved since the strength properties of a polygonal mantle of such shape are better than the respective properties of the mantle of a cylindrical can body for a case.

Material is also saved as the outer surface of the lower section of the can body mantle has the shape of a cylinder having an outer diameter smaller than the smallest diameter of the polygonal section of the mantle: with respect to the strength properties the thickness of the material of the lower section of the case can be smaller than that of the other sections of the case. The lower section of the mantle has been made cylindrical considering that a print may be provided on the completed product. Its dimensioning which is smaller than the middle section of the case protects the print when the aerosol container is used. The savings of material in production will be considerable in the course of time. This is one of the most important advantages achieved by the invention.

Other advantages are also achieved by the invention. For example, when made into an aerosol container, the case stays better in the hand than a case with a cylindrical mantle, especially when the spray emerging from the case must be directed with precision at a limited area and the hands are wet or perspiring, when painting or oiling, for example. An angular mantle also prevents the aerosol container from rolling along a surface, e.g., a table, and from falling off it when tipping over, thereby ruining the fragile nozzle. When used for skincare and other cosmetic products, such a non-cylindrical case has also an esthestic effect.

It is also significant that the inner surface of the mantle of a can body according to the invention is cylindrical over the entire length of the blank, i.e., over the length of the polygonal middle section, also. This is advantageous at the printing stage and necessary at the stage at which the inside is lacquered, the aim being to ensure the coverage, non-porosity and adherence of the inside lacquering. The upper section of the mantle again has to be cylindrical both on the inside and on the outside to make it possible in practice to shape the mouth of a so-called monobloc container. The printing can naturally be positioned on the cylindrical mouth section of the blank as well.

The blank is manufactured by using the cold extrusion technique known per se, in which a suitable metal, such as aluminum, softened by annealing, is extruded when cold. A device according to the invention for manufacturing a can body for a case is characterized in that the section of the extrusion ring under its upper section is polygonal like the can body to be manufactured, that the greatest inner diameter of this section of the extrusion ring is smaller than or equal to the inner diameter of the upper section of the extrusion ring, that the lower section of the extrusion ring is cylindrical in such a manner that its inner diameter is smaller than the smallest inner diameter of the polygonal middle section of the extrusion ring, and that the side walls of the ram are cylindrical.

BRIEF DESCRIPTION OF THE DRAWING

One embodiment of the invention is illustrated below with reference to the enclosed drawing in which.

DESCRIPTION OF THE PREFERRED EMBODIMENTS

Figure 1:
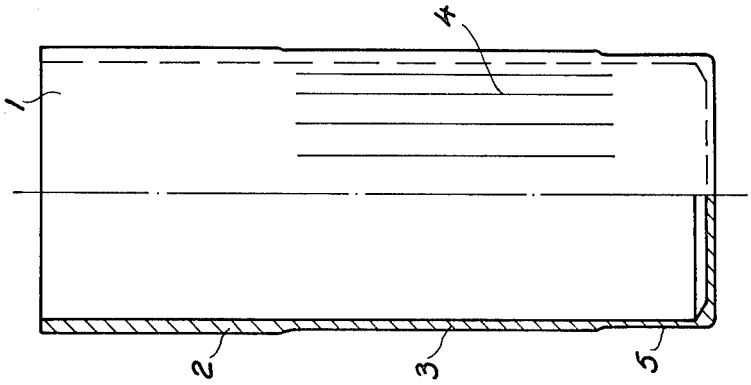
FIG. 1 depicts a can body for a case according to the invention, partly as a longitudinal cross section.
Figure 5:
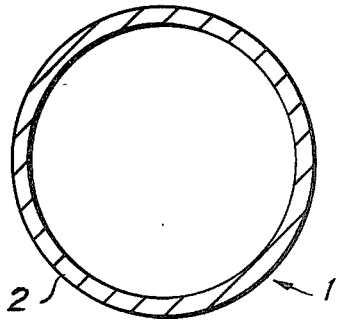
FIGS. 5, 6 and 7 show the crosssections of sections 2, 3 and 5, respectively, of FIG. 1.
Figure 6:
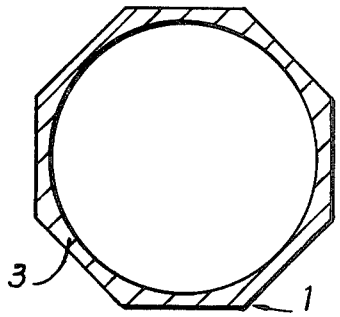
Figure 7:
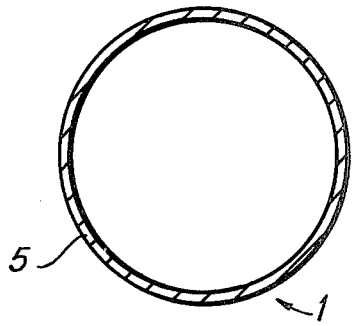

FIG. 1 shows a can body for a case 1 whose mouth section 2 has a greater diameter and thicker wall than the middle section 3, whose outer surface 4 is polygonal in a cross section of the mantle. The greatest outer diameter of the middle section 3 is smaller than the outer diameter of the mouth section 2. The lower section 5 of the blank mantle is cylindrical, and its outer diameter is smaller than the smallest outer diameter of the middle section 3. Each of the respective sections are separated from one another by transition points 10, 11 as shown in FIG. 1. These points represent the break points of the respective constant thicknesses of each of the sections 2, 3, 5.

Figure 2:
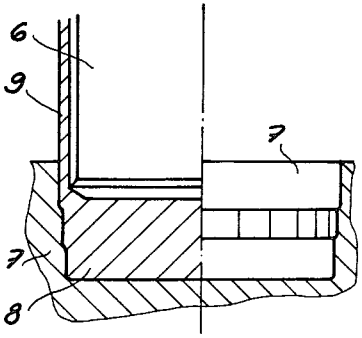

FIG. 2 shows an extrusion device to be used for manufacturing a blank for a case; it comprises a ram 6 and an extrusion ring 7. The material of the aluminum layer 8 is extruded by the stroke of the ram 6 up into the space 9 between the ram and the extrusion ring. FIG. 2 shows the stage at which the cylindrical mouth section 2 of the can body is being extruded; this section is produced by the great diameter upper section of the extrusion ring.

Figure 4:
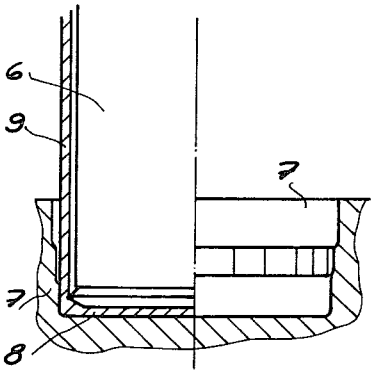
FIGS. 2–4 depict an extrusion device for manufacturing a can body for a case, at different stages of operation, also partly as cross sections.
Figure 3:
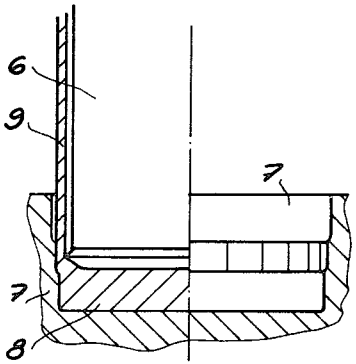

FIG. 3 shows the next stage, i.e., the extrusion of the angular middle section 3 of the mantle. It is produced by the respectively shaped middle section of the extrusion ring 7; the greatest inner diameter of this section is smaller than the inner diameter of the upper section of the extrusion ring. FIG. 4 shows the third stage, i.e., the extrusion of the lower section 5 of the mantle, produced by the cylindrical lower section of the extrusion ring 7; the inner diameter of this section of the extrusion ring 7 is smaller than the smallest inner diameter of the angular middle section 8 of the ring.

The can body for a case according to the invention and the device for manufacturing it can be varied within the following patent claims. The invention is not limited to case blanks for aerosol containers but it covers can body for even other types of containers and cases in general in which the above advantageous properties of the can body prove their value. One example is a body for felt-tipped-pen tubes.

What is claimed is:

1. An aluminum can body for use with an aerosol container being formed of a plurality of distinct contiguous sections defined by a base; a bottom section extending upwardly from said base being integral therewith; a middle section extending in turn upwardly from said bottom section; a mouth section extending in an upwardly direction from said middle section; each of said respective sections being of constant thickness except at definable transition points serving to separate said bottom section from said middle section, and said middle section from said mouth section; said respective sections being further defined by each section having a greater thickness than its neighbor for an entire length along a line of travel from the lowermost point of said bottom section to the top of said mouth section, said body including: an interior wall surface extending from said base to said mouth section at its terminus, being uniformly cylindrical in cross section and of constant diameter; said mouth section being further defined by an exterior surface having a cylindrical cross section for its entire length and a wall thickness greater than the remainder of any of the sections comprising said body; said middle section extending between said mouth and bottom sections respectively and forming a regular polygon therebetween having an outer diameter at its greatest dimensions smaller than or equal to the outer diameter of said mouth section; and said bottom section exterior having a cylindrical cross section for its entire length and a wall thickness smaller than that of the remainder of the portions forming said can body.

* * * * *